US006298811B1

(12) United States Patent
Sawada et al.

(10) Patent No.: US 6,298,811 B1
(45) Date of Patent: Oct. 9, 2001

(54) STRATIFIED SCAVENGING TWO-CYCLE ENGINE

(75) Inventors: Toshiharu Sawada, Fuchu; Masanori Noguchi, Higashimurayama; Buhei Kobayashi, Sagamihara, all of (JP)

(73) Assignees: Komatsu Zenoah Co., Kawagoe; Petroleum Energy Center, Minato-ku, both of (JP)

( * ) Notice: Subject to any disclaimer, the term of this patent is extended or adjusted under 35 U.S.C. 154(b) by 0 days.

(21) Appl. No.: 09/242,385

(22) PCT Filed: Sep. 29, 1998

(86) PCT No.: PCT/JP97/04360

§ 371 Date: Feb. 16, 1999

§ 102(e) Date: Feb. 16, 1999

(51) Int. Cl.[7] ..... F02B 33/04
(52) U.S. Cl. ..... 123/73 A; 123/73 C; 123/73 PP
(58) Field of Search ..... 123/65 R, 73 A, 123/73 C, 73 PP, 73 R

(56) References Cited

U.S. PATENT DOCUMENTS

| | | | | |
|---|---|---|---|---|
| 3,916,851 | * | 11/1975 | Otani | 123/73 A |
| 4,075,985 | * | 2/1978 | Iwai | 123/73 A |
| 4,185,598 | * | 1/1980 | Onishi | 123/73 A |
| 4,248,185 | * | 2/1981 | Jaulmes | 123/73 R |
| 4,253,433 | * | 3/1981 | Blair | 123/73 R |
| 4,625,688 | * | 12/1986 | Takayasu | 123/73 B |
| 4,899,698 | * | 2/1990 | Thery | 123/65 A |
| 5,503,119 | * | 4/1996 | Glover | 123/73 B |
| 5,775,274 | * | 7/1998 | Duret et al. | 123/73 A |
| 6,112,708 | * | 9/2000 | Sawada et al. | 123/73 PP |
| 6,135,072 | * | 10/2000 | Kishita | 123/73 A |

FOREIGN PATENT DOCUMENTS

| | | |
|---|---|---|
| 40 07 466 A | 2/1991 | (DE) . |
| 195 20 944 A1 | 1/1996 | (DE) . |
| 2 678 682 A1 | 1/1993 | (FR) . |
| 51-160721 | 12/1976 | (JP) . |
| 53-082615 | 7/1978 | (JP) . |
| 55-4518 | 2/1980 | (JP) . |
| 57-183520 A | 11/1982 | (JP) . |
| 58-5423 | 1/1983 | (JP) . |
| 61-053520 | 4/1986 | (JP) . |
| 61-147330 | 9/1986 | (JP) . |
| 09-125966 A | 5/1997 | (JP) . |
| 9-125966 | 5/1997 | (JP) . |
| 10-121974 | 5/1998 | (JP) . |

* cited by examiner

*Primary Examiner*—Noah P. Kamen
*Assistant Examiner*—Hai Huynh
(74) *Attorney, Agent, or Firm*—Sidley Austin Brown & Wood

(57) ABSTRACT

A stratified scavenging two-cycle engine, whose simple configuration can satisfy the regulation of emission rate of THC in exhaust gas, includes: a cylinder block (4), housing a piston (1) so as to be vertically slidable and having an exhaust port (14) and a scavenging port (16) in a sidewall; a scavenging flow passage (22), for connection between a crank chamber (8) and the scavenging port (16); an air supply flow passage (24), connected to the scavenging flow passage (22) and supplying air through a check valve (26); and a mixture supply flow passage (20), for supplying mixture to the crank chamber (8). The supply quantity ratio R=qa/Qf, which is the ratio of a supply quantity qa of air flowing through the air supply flow passage (24) to a supply quantity Qf of mixture flowing through the mixture supply flow passage (20) during a suction stroke in which pressure in the crank chamber (8) is negative, is in the range of $0.7 \leqq R \leqq 1.4$.

20 Claims, 4 Drawing Sheets

STRATIFIED SCAVENGING TWO-CYCLE ENGINE

TECHNICAL FIELD

The present invention relates to a stratified scavenging two-cycle engine and, more particularly, to a stratified scavenging two-cycle engine which includes an air supply flow passage, for supplying air, and a mixture supply flow passage, for supplying mixture separately, and which conducts the purification of exhaust gas by setting the ratio of the flow rates through the two flow passages at a predetermined valve.

BACKGROUND ART

As for a two-cycle internal combustion engine, it is generally known that in an exhaust stroke a part of the fuel mixture, which is fed into a cylinder chamber, flows out of an exhaust port to an exhaust flow passage along with combustion gas and is exhausted to the outside, thus causing air pollution.

The engine of Japanese Utility Model Publication No. 55-4518 is proposed as an example of a solution to the aforesaid problem. According to the above, a variable valve is provided in an air supply flow passage, which introduces air into a scavenging flow passage, connected to a scavenging port, owing to the negative pressure in the crank chamber before starting a scavenging stroke, the variable valve passing an extremely small quantity of air, including a zero flow, in an operation state of low rotation and low load operation of the engine, and increasing the flow rate of air in states other than the aforesaid operation state. Thus, in a scavenging stroke in which the scavenging port is opened, air is fed into a fuel flow passage from the crank chamber to form a layer of air between the combustion gas and a scavenging flow in the cylinder chamber, thereby preventing blow-by of the fuel mixture. In addition, the aforesaid air supply quantity is zero or very small at the time of low rotation and low load operation of the engine, thus preventing an excessive rarefaction of the fuel mixture, eliminating poor ignition, and stabilizing the combustion operation. Moreover, it is described that the aforesaid air supply quantity into the cylinder chamber increases at the time of low rotation and low load operation of the engine, thus effectively fulfilling the aforesaid operation of preventing blow-by of mixture.

The engine of Japanese Laid-open Patent No. 58-5423 is proposed as another example. According to that document, a crank chamber compression two-cycle internal combustion engine has an exhaust port and a scavenging port in the sidewall of a cylinder chamber, and the exhaust port and the scavenging port are opened and closed by a sidewall of the piston. Air is sucked into a scavenging flow passage, connected to the scavenging port through an air supply flow passage, due to negative pressure in the crank chamber, and sucked air is fed into the cylinder chamber prior to the fuel mixture which is sent from the crank chamber at beginning of a scavenging stroke in which the scavenging port is opened. At this time, it is intended that the scavenging port is not opened to the crank chamber due to the sidewall of the piston even at a lower dead center, and that the scavenging flow passage, connected to the scavenging port, is at least more than twice as long as that of the conventional crank chamber compression two-cycle internal combustion engine. Moreover, the total volume of the scavenging port and the scavenging flow passage is designed to be 20% or more of the stroke volume. Thus, an initial part of the scavenge, which is blown to exhaust, can be almost entirely an air component with an extremely low fuel content. Accordingly, the quantity of an initial scavenge, which is not mixed with the fuel mixture in the crankcase, can be selected so as to be an optimum value according to the volume of the scavenging flow passage. When a liquid fuel, such as gasoline or the like, is used, a large quantity of liquid fuel, adhering to the wall surface of the scavenging flow passage, evaporates, due to the high speed flow of sucked air accompanied by pulsation, and is mixed in the initial part of scavenge and blown to exhaust with the scavenge, thereby significantly reducing the stratified scavenging effect of this system. It is described, however, that the use of fuel gas almost prevents the mixing of the fuel into the sucked air in the scavenging flow passage.

In the aforesaid Japanese Utility Model Publication No. 55-4518, the quantity of air supplied is zero or very small at the time of low rotation and low load operation of the engine, thus preventing excessive rarefaction of the fuel mixture, eliminating poor ignition, and stabilizing the combustion operation. Moreover, the aforesaid quantity of air supplied into the cylinder chamber increases at the time of low rotation and low load operation of the engine, thus effectively fulfilling the aforesaid operation of preventing blow-by of mixture. However, in recent years, a demand for purification of the exhaust has increased more and more, the emission regulation has tightened up, and the purification of the exhaust gas at the time of the whole range of rotation of the engine, as well as at the time of low rotation and low load operation of the engine, is desired. For instance, in California 1999 Regulation as an example, it is demanded that the emission rate of total hydrocarbon (hereinafter referred to as "THC") be not more than 50 [g/HP*h]. Therefore, there is a disadvantage in that it is difficult for the above regulation to be only satisfied with the engine of Japanese Utility Model Publication No. 55-4518.

According to the aforesaid Japanese Laid-open Patent No. 58-5423, the scavenging flow passage is designed to be at least more than twice as long as that of the conventional crank chamber compression two-cycle internal combustion engine, and the total volume of the scavenging port and the scavenging flow passage is designed to be 20% or more of the stroke volume. However, this is an art applied only to fuel gas. With the use of fuel gas, blow-by is prevented. On the contrary, with the use of a liquid fuel, such as gasoline or the like, a large quantity of liquid fuel adhering to the wall surface of the scavenging flow passage evaporates, due to the high speed flow of sucked air accompanied by pulsation, and is mixed in the initial part of the scavenge and blown to exhaust with the scavenge. In addition, since the scavenging flow passage is provided outside of the crankcase, there arise disadvantages in that the crankcase is increased in size and the production becomes difficult.

SUMMARY

In view of the aforesaid disadvantages of the conventional engines, an object of the present invention is to provide a stratified scavenging two-cycle engine which includes an air supply flow passage for supplying air and a mixture supply flow passage for supplying mixture separately and whose simple configuration can satisfy the regulation of the emission rate of THC in the exhaust gas by setting the ratio of the flow rates through the two flow passages at a predetermined value.

In a first aspect of a stratified scavenging two-cycle engine according to the present invention for attaining the aforesaid object, the stratified scavenging two-cycle engine is characterized in that it includes: a piston; a cylinder block, for housing the piston was to be vertically slidable and having an exhaust port and a scavenging port in a sidewall; a crankcase, connected to the cylinder block; a scavenging flow passage for connection between a crank chamber, provided in the crankcase, and the scavenging port; an air supply flow passage, connected to the scavenging flow passage, for supplying air through a check valve; and a mixture supply flow passage, for supplying to the crank chamber a mixture to which fuel from a fuel supply means is supplied, wherein the supply quantity ratio R=qa/Qf, which is the ratio of a supply quantity qa of air flowing through the air supply flow passage to a supply quantity Qf of mixture flowing through the mixture supply flow passage during a suction stroke in which the pressure in the crank chamber is negative, is in the range of $0.7 \leqq R \leqq 1.4$. Moreover, the supply quantity ratio R can be in the range of $0.8 \leqq R \leqq 1.2$.

According to the aforesaid configuration, the pressure in the crank chamber becomes negative with an upward movement of the piston, and the pressure in the scavenging flow passage, connected to the crank chamber, and the pressure in the air supply flow passage also become negative. Thus, air is sucked into the scavenging flow passage, which is connected via the check valve to the air supply flow passage and the crank chamber; and hence a predetermined quantity of fresh air is supplied. At this time, mixture, to which fuel is supplied via the mixture supply passage, is sucked into the crank chamber, and thus a predetermined quantity of mixture is supplied to the crank chamber. The supply quantity ratio R of the supply quantity qa of air supplied to the scavenging flow passage and the crank chamber to the supply quantity Qf of mixture supplied to the crank chamber is set to be in the range of $0.7 \leqq R \leqq 1.4$, and more preferably in the range of $0.8 \leqq R \leqq 1.2$. When the supply quantity ratio R supplied to the engine is less than 0.7, the blow-by of fuel to the exhaust port increases, thereby deteriorating the THC emission rate. On the contrary, when the supply quantity ratio R supplied to the engine is more than 1.4, the time when mixture in the crank chamber flows into the cylinder chamber is delayed and the ratio of fuel in mixture inside the crank chamber needs to be increased. As a result, when the supply quantity ratio R is more than 1.4, fuel flows into the cylinder chamber in a liquid film state, which makes the satisfactory formation of mixture in the cylinder chamber difficult. Consequently, irregular combustion and output reduction, due to delay of combustion, occur and the THC emission rate deteriorates. Contrary to this, by maintaining the supply quantity ratio R within the aforesaid range of the present invention, the blow-by of fuel caused when the supply quantity ratio R is less than 0.7 can be prevented and the occurrence of incomplete combustion in the cylinder chamber caused when the supply quantity ratio is more than 1.4 can be prevented. As a result, it is confirmed that the emission rate of THC in the exhaust gas exhausted from the stratified scavenging two-cycle engine is not more than 50 [g/HP*h].

In a second aspect of a stratified scavenging two-cycle engine according to the present invention, the stratified scavenging two-cycle engine is characterized in that it includes a piston, a cylinder block, for housing the piston so as to be vertically slidable and having an exhaust port and a scavenging port in a sidewall; a crankcase connected to the cylinder block; a scavenging flow passage, for connection between a crank chamber, provided in the crankcase, and the scavenging port; an air supply flow passage, connected to the scavenging flow passage, for supplying air through a check valve; and a mixture supply flow passage, for supplying to the crank chamber a mixture to which fuel from a fuel supply means is supplied, wherein the scavenging flow passage is provided in the cylinder block, or in both the cylinder block and the crankcase, and wherein the volume Vs of the scavenging flow passage, from an end portion on the crank chamber side to the check valve in the air supply flow passage, is 70% or more of a supply quantity qa of air flowing through the air supply flow passage at full load rated power engine speed and during a suction stroke in which the pressure in the crank chamber is negative. In addition, the volume Vs can be 80% or more of the air supply quantity qa.

According to the aforesaid second configuration, similarly to the aforesaid first configuration, the pressure in the crank chamber becomes negative with upward movement of the piston, whereby a predetermined quantity of fresh air is supplied to the scavenging flow passage and the crank chamber, and a predetermined quantity of mixture, to which fuel is supplied, is supplied to the crank chamber. At this time, since the volume Vs of the scavenging flow passage is set to be 70% or more and more preferably 80% or more at full load rated power engine speed, the scavenging flow passage is filled with fresh air, and the exhaust gas within the cylinder chamber is exhausted by the fresh air, whereby the inside of the cylinder chamber is filled with the remnant of the fresh air and the mixture. Liquid fuel, adhering to the scavenging flow passage is taken into the crank chamber with the fresh air which is first sucked into the scavenging flow passage. Therefore, it is confirmed that the liquid fuel, which is taken into the cylinder chamber from the scavenging flow passage at the beginning of a scavenging stroke, decreases, whereby a blow-by to exhaust with scavenge reduces, and the emission rate of THC in the exhaust gas exhausted from the stratified scavenging two-cycle engine is not more than 40 [g/HP*h].

Furthermore, the aforesaid first and second configurations can be combined. Specifically, a configuration is suitable in which: a predetermined quantity of fresh air is supplied to the scavenging flow passage and the crank chamber during a suction stroke in which the pressure in the crank chamber is negative; a predetermined quantity of mixture, to which fuel is supplied, is supplied to the crank chamber; the supply quantity ratio R is in the range of $0.7 \leqq R \leqq 1.4$ and more preferably in the range of $0.8 \leqq R \leqq 1.2$; and the scavenging flow passage volume Vs is 70% or more, and more preferably 80% or more, of the air supply quantity qa at full load rated power engine speed.

Consequently, the blow-by of fuel is reduced and a uniform mixture is formed in the cylinder chamber, thus raising the combustion efficiency. Since the pressure in the crank chamber becomes negative with upward movement of the piston, a predetermined quantity of fresh air is supplied to the scavenging flow passage and fresh air also enters the crank chamber. Therefore, liquid fuel, adhering to the scavenging flow passage, is taken into the crank chamber, and fresh air in the scavenging flow passage pushes combustion gas in the cylinder chamber outwardly, whereby the inside of the cylinder chamber is filled with the remnant of the fresh air and mixture and the blow-by of fuel is reduced. In addition, since the scavenging flow passage volume Vs is 70% or more and more preferably 80% or more, of the air supply quantity qa, a mixture in the crank chamber uniformly enters the cylinder chamber, thus improving combustion efficiency. Contrary to this, if the scavenging flow passage volume Vs is not more than 70%, the air supply quantity qa is excessively mixed with a mixture in the crank chamber, thereby increasing the blow-by of fuel to the exhaust port and deteriorating the THC emission rate. It is confirmed from the aforesaid results that the emission rate of THC in the emitted exhaust gas is not more than 50 [g/HP*h] if the scavenging flow passage volume Vs is 70% or more.

BEST MODE FOR CARRYING OUT THE INVENTION

A stratified scavenging two-cycle engine according to the present invention will be described in detail below with reference to the attached drawings.

Figure 1:
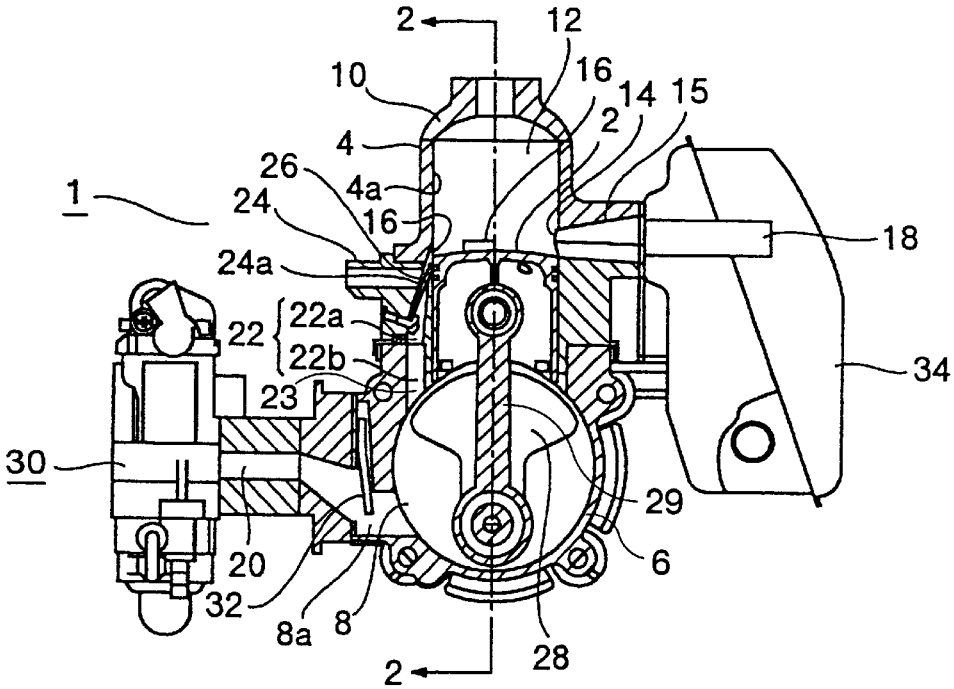
FIG. 1 is a side sectional view, of a stratified scavenging two-cycle engine according to a first embodiment of the present invention, showing a state in which the piston is positioned at the lower dead center.
Figure 2:
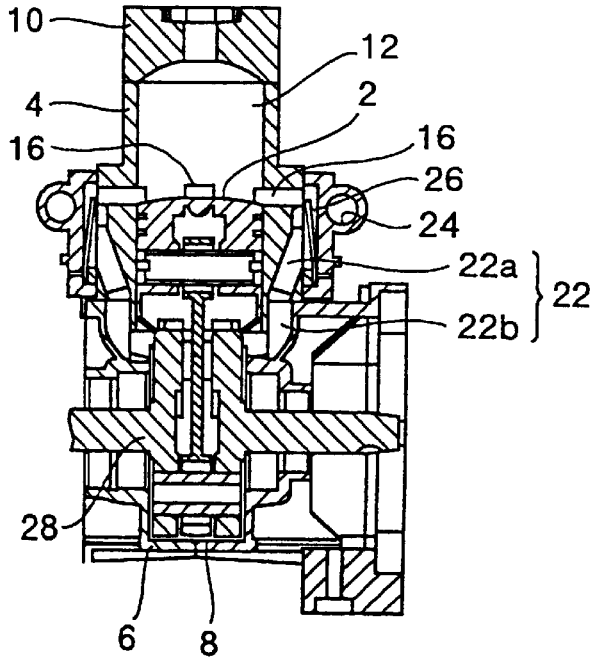
FIG. 2 is a sectional view taken along the 2—2 line in FIG. 1.
Figure 3:
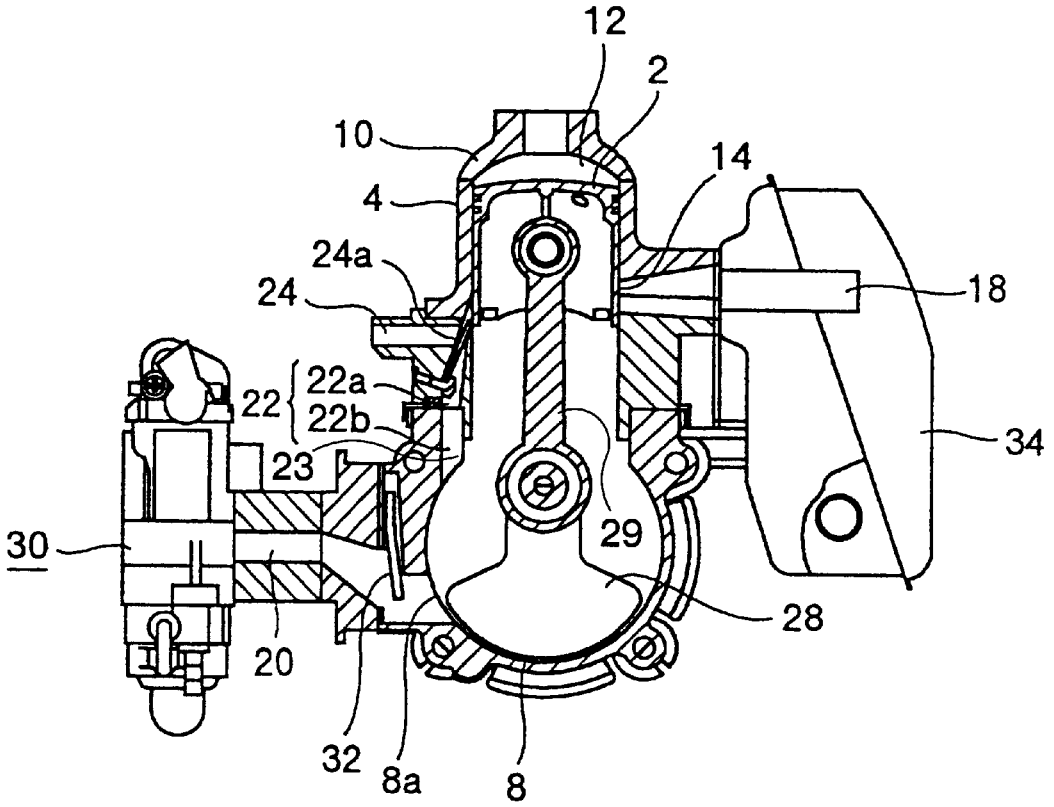
FIG. 3 is a side sectional view, of the stratified scavenging two-cycle engine according to the first embodiment of the present invention, showing a state that the piston is positioned at the upper dead center.

The configuration of a first embodiment of the stratified scavenging two-cycle engine of the present invention is shown in FIG. 1 to FIG. 3. FIG. 1 shows the entire configuration of the stratified scavenging two-cycle engine 1. A piston 2 is tightly housed in a cylinder block 4 so as to be vertically slidable. A crankcase 6 is connected to the underside of the cylinder block 4, and a crank chamber 8 is formed in the crankcase 6. A cylinder head 10 is connected to the upper end of the cylinder block 4. The piston 2, the cylinder block 4, and the cylinder head 10 form a cylinder chamber 12 to which a mixture is fed to burn and explode. Provided in a sidewall 4*a* of the cylinder block 4 are an exhaust port 14 and an exhaust passage 15, for exhausting combustion gas after combustion and explosion, and a scavenging port 16, for supplying air to the cylinder chamber 12 at the beginning of a scavenging stroke and for supplying mixture thereto after combustion gas is pressed out. In this embodiment, a scavenging port 16 is disposed opposite the exhaust port 14 and three scavenging ports 16 in all are disposed in a circumferential direction. The exhaust port 14 is connected to a muffler 34 via an exhaust pipe 18, and the combustion gas is exhausted into the atmosphere as exhaust gas from the muffler 34.

The scavenging port 16 is connected to the crankcase 6 via a scavenging flow passage 22. In this embodiment, three scavenging flow passages 22 are provided in the cylinder block 4 and the crankcase 6. Each scavenging flow passage 22 of this embodiment is composed of a flow passage 22*a*, provided in the cylinder block 4, and a port 22*b*. The port 22*b* is connected to the flow passage 22*a* in the cylinder block 4 by a downwardly extending slot 23 which is provided in the crankcase 6 and the cylinder block 4. Incidentally, each scavenging flow passage 22 can be formed only by the cylinder block 4.

An air supply flow passage 24 is connected to each scavenging flow passage 22 for communications between the cylinder block 4 and the crankcase 6. Disposed in a portion 24*a*, connecting the scavenging flow passage 22 and the air supply flow passage 24, is a check valve 26, which permits the air flow from the air supply flow passage 24 to the scavenging flow passage 22 and impedes the reverse flow. The connecting portion 24*a* is connected to the upper portion of the scavenging flow passage 22 so that the scavenging flow passage 22 can be filled with supplied air. The scavenging flow passage volume Vs, formed in the scavenging flow passage 22 of the present invention, consists of the volume of the flow passage 22*a* in the cylinder block 4, the downwardly extending slot 23 provided in the crankcase 6 and the cylinder block 4, between the port 22*b* and the check valve 26, formed in the air supply flow passage 24.

The check valve 26 is disposed in the connecting portion 24*a* in the aforesaid embodiment, but can be disposed in the air supply flow passage 24. An air flow rate control valve can be provided in the air supply flow passage 24 to control a suction flow rate of air to be sucked, although the drawing thereof is omitted.

The crankcase 6 forms a crank chamber 8, in which a crank 28 is rotatably actuated via a connecting rod 29, connected to the piston 2. Provided in the crank chamber 8 is a mixture supply port 8*a*, to which a mixture supply flow passage 20 is connected. A fuel supply system 30, for supplying liquid fuel such as gasoline or the like to form an air-fuel mixture, is connected to the mixture supply flow passage 20. Disposed in a portion connecting the mixture supply flow passage 20 and the crank chamber 8 is a mixture check valve 32, which permits only the flow from the mixture supply flow passage 20 to the crank chamber 8 and impedes the reverse flow. In addition, an air cleaner, which is not shown, is disposed upstream of the mixture supply flow passage 20.

The operation of the aforesaid configuration, will be described below.

As for the stratified scavenging two-cycle engine 1, with an upward movement of the piston 2 from the lower dead center, the pressure in the crank chamber 8 starts to lower, and the scavenging port 16 and the exhaust port 14 are closed in sequence by the sidewall of the piston 2. Subsequently, air and mixture, which are supplied into the cylinder chamber 12 from the scavenging flow passage 22, are compressed in the cylinder chamber 12. Meanwhile, mixture, supplied from the mixture supply flow passage 20, is sucked into the crank chamber 8. At this time, air from the air supply flow passage 24 flows through the scavenging flow passage 22; and liquid fuel, adhering to the inside of the scavenging flow passage 22, is taken into the crank chamber 8 by the flow of air. In this situation, during a suction stroke in which the pressure in the crank chamber 8 is negative, a predetermined quantity of fresh air is supplied to the scavenging flow passage 22 and the nearby crank chamber 8 which is connected to the scavenging flow passage 22; and moreover a predetermined quantity of mixture, to which fuel is supplied, is supplied to the crank chamber 8. The suction stroke is generally a period from the lower dead center to the upper dead center. However, in the stratified scavenging two-cycle engine 1, even when the piston 2 passes the upper dead center and starts to descend, the pressure in the crank chamber 8 is negative, and thus air and fuel are sucked into the crank chamber 8. At this time, the ratio of the quantity of air to the quantity of mixture supplied to the scavenging flow passage 22 and the crank chamber 8, that is, the supply quantity ratio R (R=qa/Qf) which is the ratio of a supply quantity qa [$cm^3$] of air flowing through the air supply flow passage 24 to a supply quantity Qf [$cm^3$] of mixture flowing through the mixture supply flow passage 20, is in the range $0.7 \leqq R \leqq 1.4$. Incidentally, it is preferable that the supply quantity ratio R is in the range of $0.8 \leqq R \leqq 1.2$. Further, the scavenging flow passage volume Vs [$cm^3$] of the scavenging flow passage 22 is 70% or more of the air supply quantity qa [$cm^3$]. Therefore, the air supply flow passage 24 becomes filled with air, and the communication portion of the scavenging flow passage 22 at the upper portion in the crank chamber 8 also becomes filled with air. Incidentally, it is preferable that the scavenging flow passage volume Vs is 80% or more of the air supply quantity qa. As an example of obtaining the range of the aforesaid supply quantity ratio R, the ratio of the sectional area of the air supply flow passage 24, through which air passes, to the sectional area of the mixture supply flow passage 20, through which mixture passes, is set so that the aforesaid range can be obtained. Alternatively, it is possible to obtain the aforesaid range by controlling an air flow rate control valve, which is not shown, and a mixture flow rate control valve, which is provided in the fuel supply system 30.

Next, when the piston 2 reaches the vicinity of the upper dead center, the mixture within the cylinder chamber 12 is ignited by an ignition plug (not shown). Mixture, with predetermined concentration supplied into the cylinder chamber 12, burns and explodes, thus increasing the pressure in the cylinder chamber 12 and making the piston 2 descend. When the piston 2 descends to a predetermined position, the exhaust port 14 is opened and then the scavenging port 16 is opened in sequence. The opening of the exhaust port 14 permits combustion gas to be exhausted via the exhaust port 14 and the muffler 20 as exhaust gas into the atmosphere. The combustion gas is exhausted, the pressure in the cylinder chamber 12 is sharply lowered, and the scavenging ports 16 are opened. In addition, with the downward movement of the piston 2, the crank chamber 8 and the scavenging flow passage 22 are pressurized so that air, stored in the scavenging flow passage 22, is jetted from the scavenging ports 16 into the cylinder chamber 12 and the combustion gas remaining in the cylinder chamber 12 is forcibly exhausted from the exhaust port 14 by the jetted air. Thereafter, mixture in the crank chamber 8 goes via the scavenging flow passage 22 and the scavenging ports 16 into the cylinder chamber 12, thus completing the scavenge and preparing for the next combustion and explosion.

Subsequently, the piston 2 starts to ascend again, and the aforesaid cycle is repeated, whereby the stratified scavenging two-cycle engine 1 continuously rotates.

According to the stratified scavenging two-cycle engine 1 constructed as described above, the inside of the cylinder chamber 12 can be scavenged by a predetermined quantity of air stored in the scavenging flow passage 22, which enables a great decrease in the blow-by in a scavenging stroke of mixture. Consequently there is an advantage in that the exhaust gas is made to be cleaner.

Figure 4:
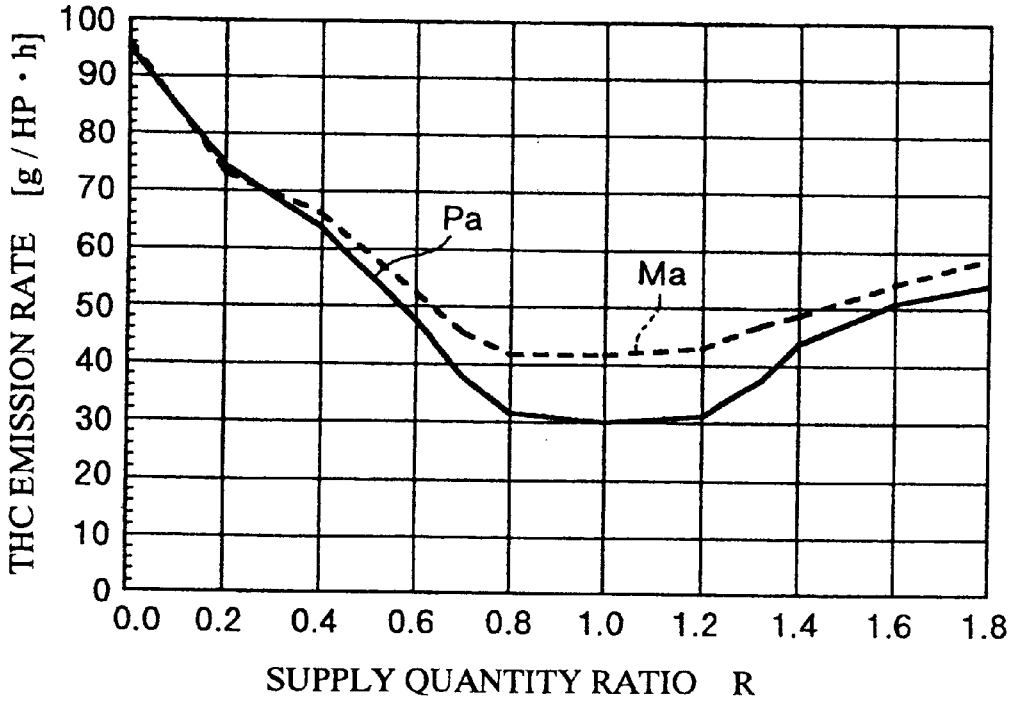
FIG. 4 is a diagram, according to the first embodiment of the present invention, showing the relationship between the supply quantity ratio and the THC emission rate.
Figure 5:
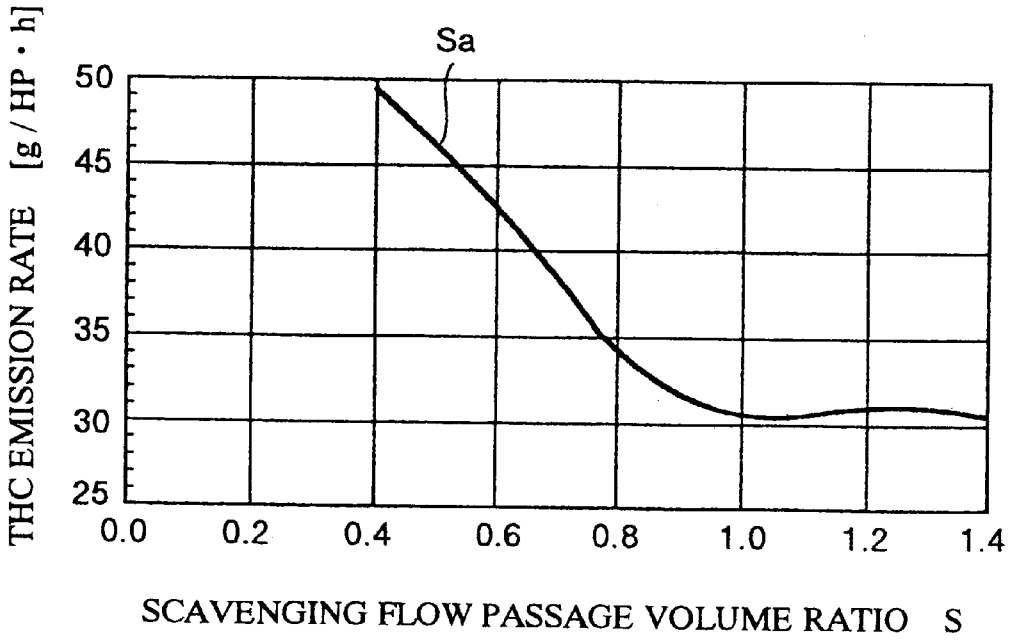
FIG. 5 is a diagram, according to the first embodiment of the present invention, showing the relationship between the scavenging flow passage volume ratio and the THC emission rate.

The confirmed results of the above are shown in FIGS. 4 and 5, and are described below.

In FIG. 4, the horizontal axis represents the supply quantity ratio R (R=qa/Qf) of the air supply quantity qa [$cm^3$] to the mixture supply quantity Qf [$cm^3$], and the vertical axis represents the THC emission rate. The full line Pa shows the THC emission rate relative to the supply quantity ratio R when the scavenging flow passage volume Vs [$cm^3$] is 100% of the air supply quantity qa [$cm^3$]. The broken line Ma shows the THC emission rate relative to the supply quantity ratio R when the scavenging flow passage volume Vs [$cm^3$] is 60% of the air supply quantity qa [$cm^3$]. It is confirmed from the above results that the THC emission rate of not more than 50 [g/HP*h] in California Regulation in 1999 can be fully satisfied, if the air supply ratio R (R=qa/Qf) is in the range of $0.7 \leqq R \leqq 1.4$. It is also confirmed that even if the regulation is further tightened up in the future, a THC emission rate up to not more than 35 [g/HP*h] can be fully satisfied, if $0.8 \leqq R \leqq 1.2$.

In FIG. 5, the horizontal axis represents the scavenging flow passage volume ratio S (S=Vs/qa) of the scavenging flow passage volume Vs to the air supply quantity qa [$cm^3$] when the supply quantity ratio R (R=qa/Qf) of the air supply quantity qa [$cm^3$] to the mixture supply quantity Qf [$cm^3$] is 1, and the vertical axis represents the THC emission rate. A full line Sa shows the THC emission rate relative to the scavenging flow passage volume ratio S. It is confirmed from these results that the THC emission rate of not more than 50 [g/HP*h] in California Regulation in 1999 can be fully satisfied, if the scavenging flow passage volume Vs of the scavenging flow passage 22 is 70% or more of the air supply quantity qa [$cm^3$]. It is also confirmed that even if the regulation is further tightened up in the future, a THC emission rate up to not more than 35 [g/HP*h] can be fully satisfied, if the scavenging flow passage volume Vs is 80% or more.

Figure 6:
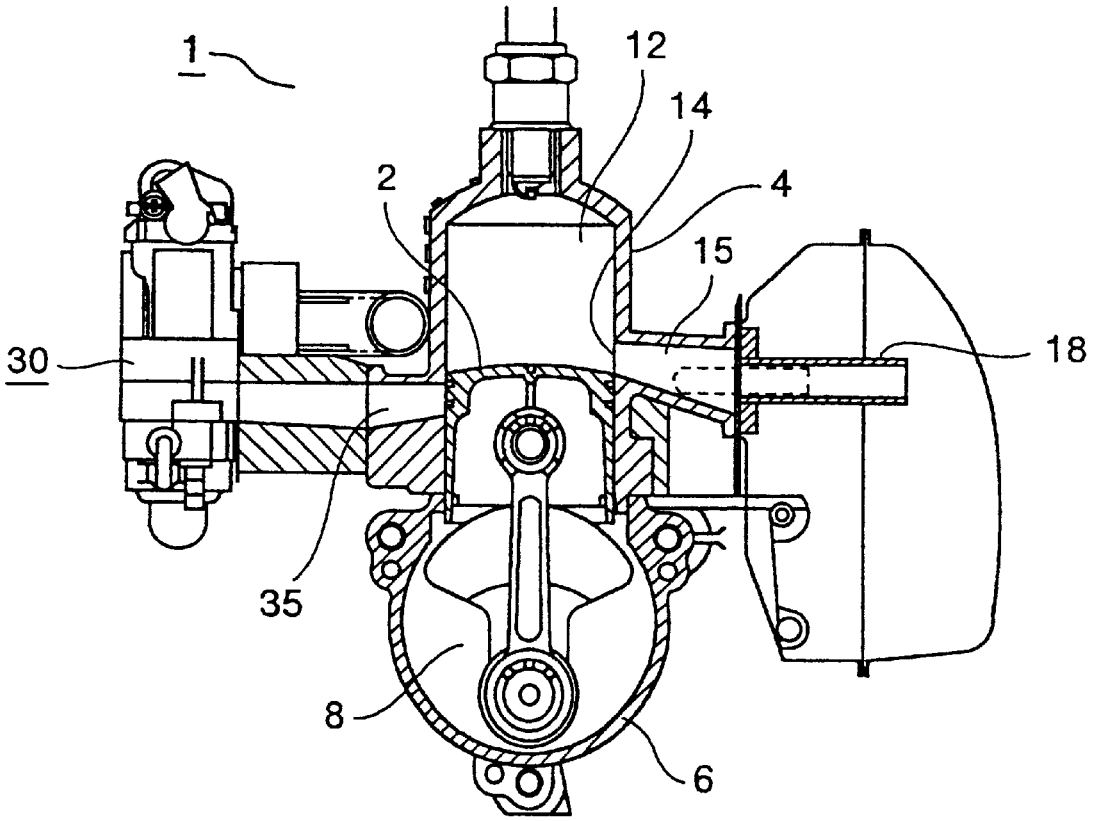
FIG. 6 is a side sectional view, of a stratified scavenging two-cycle engine according to a second embodiment of the present invention, showing a state in which the piston is positioned at the lower dead center.

FIG. 6 shows a second embodiment of the stratified scavenging two-cycle engine 1 of the present invention. The mixture supply flow passage 20 is connected to the crank chamber 8 in the first embodiment shown in FIG. 1, while a mixture supply flow passage 35 is connected to the cylinder chamber 12 in the second embodiment. The opening and closing of the mixture supply flow passage 35 is conducted by the upward and downward movement of the piston 2. It is confirmed that it is effective also in the stratified scavenging engine 1 in the second embodiment as is the case with the first embodiment.

INDUSTRIAL AVAILABILITY

The present invention is useful as a stratified scavenging two-cycle engine whose simple configuration can satisfy the regulation of emission rate of THC in exhaust gas.

What is claimed is:

1. A stratified scavenging two-cycle engine comprising:

a cylinder block having a cylinder chamber therein, said cylinder block having a sidewall which at least partially defines said cylinder chamber;

a piston, positioned in said cylinder chamber so as to be slidable therein;

said sidewall of said cylinder block having an exhaust port and at least one scavenging port formed therein in fluid communication with said cylinder chamber;

a crankcase, connected to said cylinder block and containing a crank chamber;

at least one scavenging flow passage in at least one of said cylinder block and said crankcase for providing fluid communication between said crank chamber and a respective scavenging port;

a check valve;

an air supply flow passage, for supplying air through said check valve to a scavenging flow passage; and a mixture supply flow passage in fluid communication with said crank chamber, for supplying a fuel containing mixture to said crank chamber;

wherein R=qa/Qf, with R being a supply quantity ratio in the range defined by $0.7 \leqq R \leqq 1.4$, with qa being a supply quantity of air flowing through said air supply flow passage during a suction stroke in which pressure in said crank chamber is negative and Qf being a supply quantity of mixture flowing through said mixture supply flow passage during a suction stroke in which pressure in said crank chamber is negative.

2. A stratified scavenging two-cycle engine in accordance with claim 1, wherein R is in the range defined by $0.8 \leqq R \leqq 1.2$.

3. A stratified scavenging two-cycle engine in accordance with claim 1, wherein each scavenging flow passage is provided in said sidewall of said cylinder block.

4. A stratified scavenging two-cycle engine in accordance with claim 1, wherein each scavenging flow passage is provided in said sidewall of said cylinder block and in said crankcase.

5. A stratified scavenging two-cycle engine in accordance with claim 1, wherein a volume Vs of a scavenging flow passage extending substantially from said crank chamber to said check valve is at least 70% of said supply quantity qa of air.

6. A stratified scavenging two-cycle engine in accordance with claim 5, wherein R is in the range defined by $0.8 \leqq R \leqq 1.2$.

7. A stratified scavenging two-cycle engine in accordance with claim 6, wherein each scavenging flow passage is provided in said sidewall of said cylinder block.

8. A stratified scavenging two-cycle engine in accordance with claim 6, wherein each scavenging flow passage is at least partially defined by said sidewall of said cylinder block and said crankcase.

9. A stratified scavenging two-cycle engine in accordance with claim 1, wherein a volume Vs of said at least one scavenging flow passage extending substantially from said crank chamber to said check valve is at least 80% of said air supply quantity qa.

10. A stratified scavenging two-cycle engine in accordance with claim 9, wherein R is in the range defined by $0.8 \leqq R \leqq 1.2$.

11. A stratified scavenging two-cycle engine in accordance with claim 10, wherein each scavenging flow passage is at least partially defined by said sidewall of said cylinder block.

12. A stratified scavenging two-cycle engine in accordance with claim 10, wherein each scavenging flow passage is at least partially defined by said sidewall of said cylinder block and said crankcase.

13. A stratified scavenging two-cycle engine in accordance with claim 1, wherein said check valve is disposed between said air supply flow passage and at least one of said at least one scavenging flow passage.

14. A stratified scavenging two-cycle engine comprising:

a cylinder block having a cylinder chamber therein, said cylinder block having a sidewall which at least partially defines said cylinder chamber;

a piston, positioned in said cylinder chamber so as to be vertically slidable therein;

said sidewall of said cylinder block having an exhaust port and at least one scavenging port formed there in fluid communication with said cylinder chamber;

a crankcase connected to said cylinder block and containing a crank chamber;

at least one scavenging flow passage in at least one of said cylinder block and said crankcase for providing communication between said crank chamber and a respective scavenging port;

a check valve;

an air supply flow passage, for supplying air through said check valve to a scavenging flow passage; and a mixture supply flow passage in fluid communication with said crank chamber, for supplying a fuel containing mixture to said crank chamber;

wherein a volume Vs of said scavenging flow passage extending from said crank chamber to said check valve is at least 70% of a supply quantity qa of air flowing through said air supply flow passage at full load rated power engine speed during a suction stroke in which pressure in said crank chamber is negative.

15. A stratified scavenging two-cycle engine in accordance with claim 14, wherein each scavenging flow passage is at least partially defined by said sidewall of said cylinder block.

16. A stratified scavenging two-cycle engine in accordance with claim 14, wherein each scavenging flow passage is at least partially defined by said sidewall of said cylinder block and said crankcase.

17. A stratified scavenging two-cycle engine in accordance with claim 14, wherein said volume Vs is at least 80% of said air supply quantity qa.

18. A stratified scavenging two-cycle engine in accordance with claim 17, wherein each scavenging flow passage is at least partially defined by said sidewall of said cylinder block.

19. A stratified scavenging two-cycle engine in accordance with claim 17, wherein each scavenging flow passage is at least partially defined by said sidewall of said cylinder block and said crankcase.

20. A stratified scavenging two-cycle engine in accordance with claim 14, wherein said check valve is disposed between said air supply flow passage and at least one of said at least one scavenging flow passage.

* * * * *